US005442601A

United States Patent [19]

Chen

[11] Patent Number: 5,442,601

[45] Date of Patent: Aug. 15, 1995

[54] STRUCTURE OF A ULTRATHIN CLOCK

[76] Inventor: Ching-Ti Chen, Changhua Hsien, Taiwan

[21] Appl. No.: 320,266

[22] Filed: Oct. 11, 1994

[51] Int. Cl.[6] ..... G04B 17/02; G04B 15/00

[52] U.S. Cl. ..... 368/134; 368/165; 368/179

[58] Field of Search ..... 368/76, 88, 134–138, 368/165–166, 179–183, 276

[56] References Cited

U.S. PATENT DOCUMENTS

| | | | |
|---|---|---|---|
| 2,323,796 | 7/1943 | Cole | 368/134 |
| 4,378,166 | 3/1983 | Itami et al. | 368/134 |
| 4,613,236 | 9/1986 | Nakamura | 368/165 |
| 4,829,495 | 5/1989 | Kaneko et al. | 368/134 |

*Primary Examiner*—Vit W. Miska

[57] ABSTRACT

A structure of an ultrathin clock comprises generally a roughly rectangular housing having partitioned into a first chamber on upper portion for disposing a clockwork mechanism and a dial, a second chamber on median portion for disposing a set of electric circuit and batteries, and a third chamber on the lower portion for pivoting a pendulum therein and a cover which is snap fitted to the third chamber for securing the pendulum. The pendulum has a magnet on the upper end directly under an electric coil inside the second chamber so as to actuate the pendulum to swing laterally upon the variations of the electromagnetic field between the coil and the magnet. This invention has been characterized in the thickness of the housing which is greatly thiner than that of the prior art.

3 Claims, 3 Drawing Sheets

STRUCTURE OF A ULTRATHIN CLOCK

BACKGROUND OF THE INVENTION

The present invention relates to clocks, more particularly to a structurally improved pendulum and the housing of a clock which are suitable to develop an ultrathin Prior art electromagnetic clock (as shown FIG. 1) in the type comprises generally a housing 10 and a pendulum 20, where the housing 10 is partitioned of a median chamber 101 for disposing a set of clockwork mechanism therein, a lower chamber 102 for receiving an electric circuit and batteries therein and an upper chamber 103 for pivoting the pendulum 20 thereon. Whereas, the pendulum 20 has an elongate body, a tubular hook 201 formed perpendicular to the upper end, a small cup 202 for retaining a rectangular magnet 203 therein connected to the lower end thereof and a hook means 204 for suspending a bob positioned under the receiving space 202.

When the pendulum is anchored on a knife-edge pivot axis inside the upper chamber 103 and fixed by a cover 104, the rectangular magnet 203 on lower end of the pendulum 20 is just under an electric coil inside the lower chamber 102 so as to activate the pendulum 20 to vacilate laterally with the bob by the variation of the magnetic field thereof. To prevent the pendulum 20 from being obstructed by the back side of the housing 10, a outward slope is formed in the proximing of its upper end in an intention to maintain an adequete space between the pendulum 20 and the housing. Therefore, the housing 10 of the clock must maintain a considerable thickness, which is a fatal disadvantage to develop an ultrathin electromagetic clock.

SUMMARY OF THE PRESENT INVENTION

The present invention has a main object to provide a structurally improved pendulum and the housing for developing an ultrathin electromagnetic clock in order to satisfy the user's desire.

Accordingly, the present invention of a structure of an ultrathin clock comprises generally a rectangular housing and a pendulum attached to the housing therein.

The housing has a first chamber on the upper portion for disposing the clockwork mechanism and dial, a second chamber on mediam portion for disposing the electric circuit and batteries therein and a third chamber on the lower portion for pivoting the pendulum threin which is in a roughly inverted trapezoid-shape having a window on the front side, an opening on back side, a knife-edge pivot axis at a center of the inner surface of a front wall and a pair of retaining slots on the lateral sides respectively for snapping a cover therein.

The pendulum has a flat elongate body, a tubular suspender in the proximity of the lower end, a cup perpendicular to the upper end for retaining a rectangular magnet therein and a hook means extended downward from the lower end for suspending a bob thereon.

The cover has a flat rectangular body, a corresponding knife-edge pivot axis projected from the center of the inward surface and a pair of spring tabs with reverse hook thereon protruded from the lateral side respectively.

When the pendulum attaches on its tubular suspender to the knife-edge pivot axis inside the third chamber and fixed by the rectangular cover which is snapped on the pair of spring tabs thereof into the pair of the retaining slots on the lateral side of the third chamber respectively and inserted on its pivot axis into the outward end of the tubular suspender of the pendulum so as to keep the pivot axis alignment with the corresponding pivot axis inside the third chamber and the magnet directly under an electric coil inside the second chamber. So that the pendulum, supended with a bob swings laterally on the pivot axises upon the variation of the electromagnetic field. Therefore, the thickness of the electromagnetic ultrathin clock of the present invention is greatly reduced relative to the thickness of the prior art.

The present invention will become more fully understood by reference to the following detailed description thereof when read in accompanied with the attached drawings:

DETAIL DESCRIPTION OF THE PREFERRED EMBODIMENT OF THE PRESENT INVENTION

Figure 1:
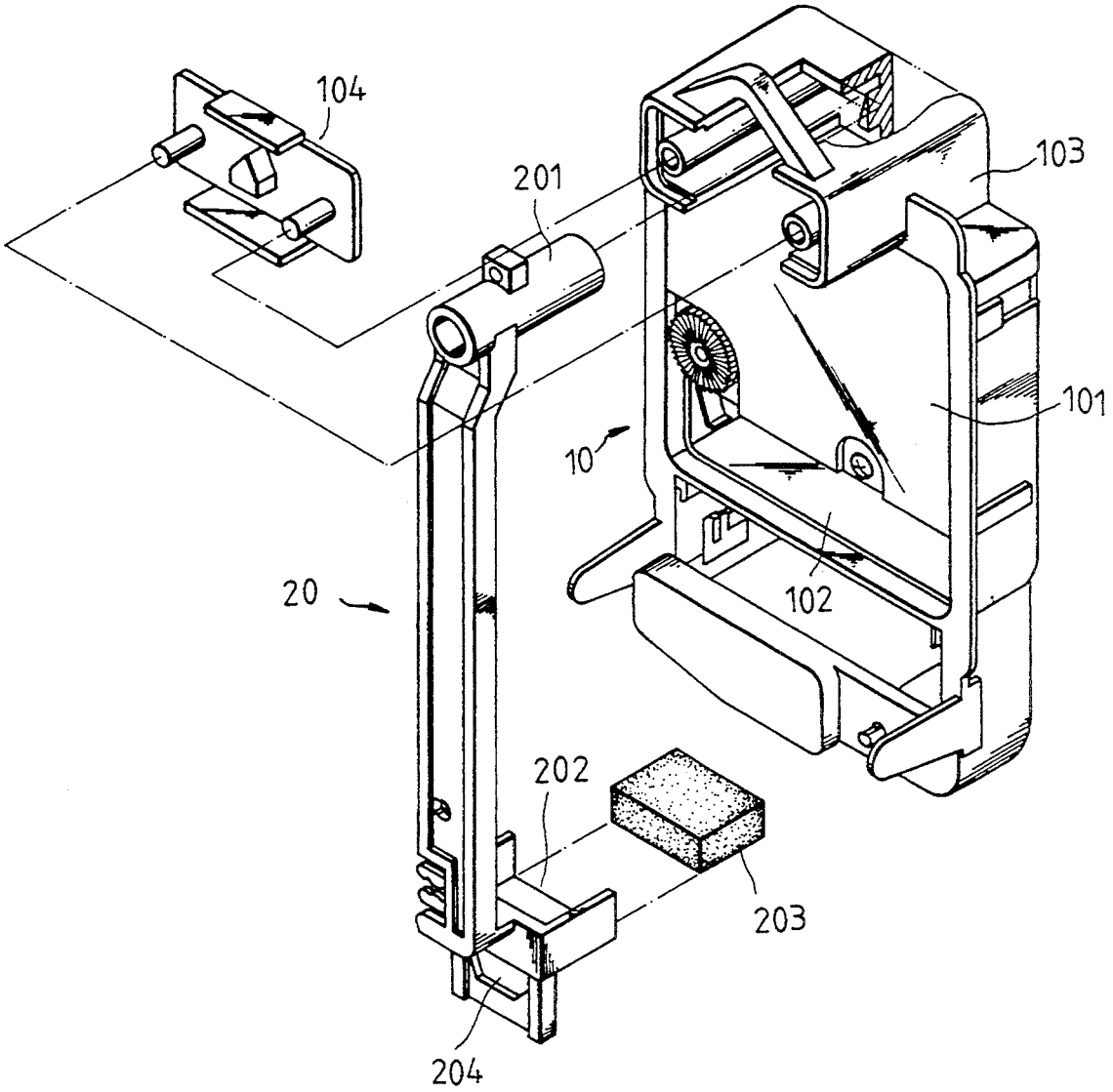
FIG. 1 PRIOR ART
FIG. 1 is an exploded perspective view to show an electromagnetic clock according to the prior art.
Figure 2:
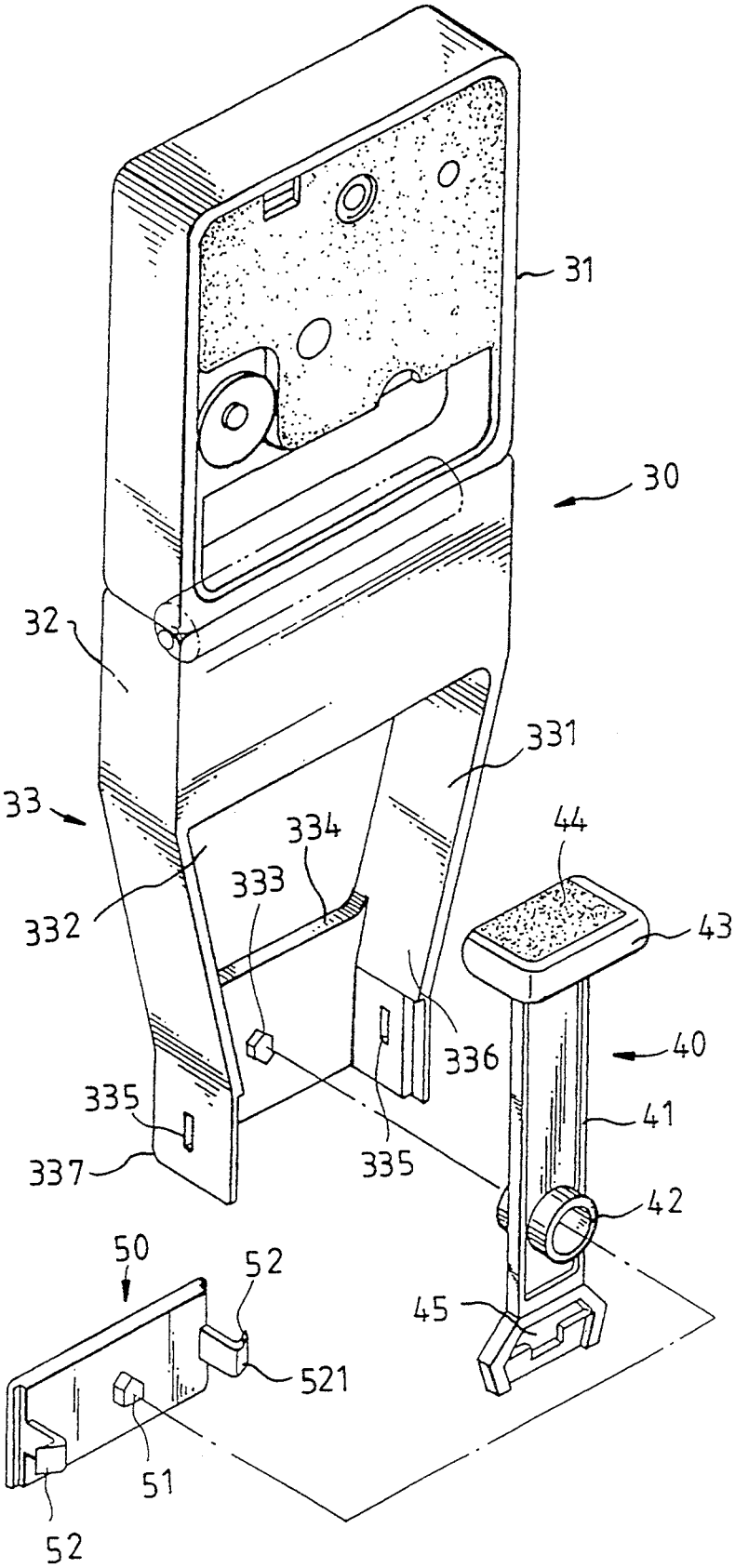
FIG. 2 is an exploded perspective view to show a preferred embodiment according to present invention.
Figure 3:
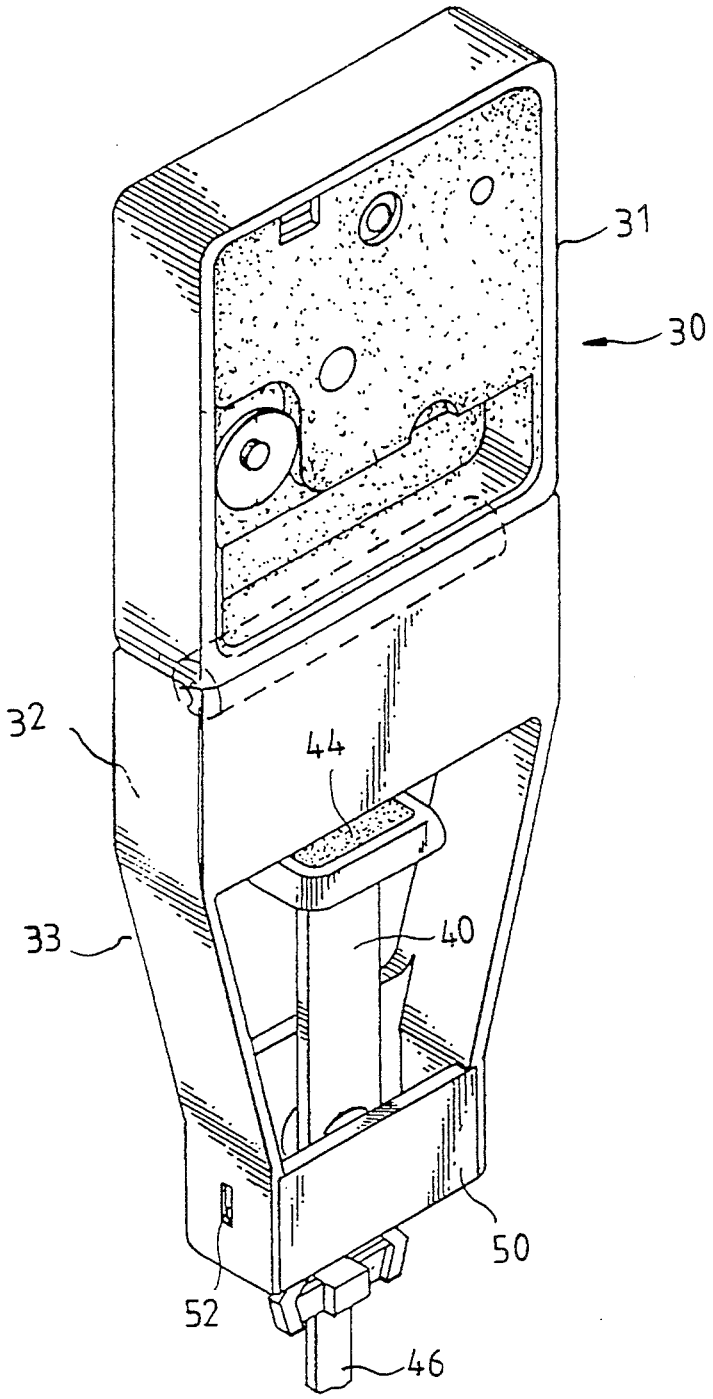
FIG. 3 is a perspective view to show an assembled electromagnetic ultrathin clock according to the present invention.

Referring to FIGS. 2 and 3. the electromagnetic ultrathin clock of the present invention comprises a generally rectangular housing 30, a pendulum 40 and a flat rectangular cover 50 thereof.

The housing 30 has been partitioned into a first chamber 31 on upper portion for disposing a clockwork mechanism and dial therein, a second chamber 32 on median portion for disposing a electric circuit and batteries therein and a third chamber 33 on lower partion for pivoting the pendulum 40 therein.

The third chamber 33 which is in a form of the inverted trapezoid comprises an opening 331 on the back side, a window 332 on the front side, a knife-edge pivot axis 333 projected from the center of the inward surface of a front wall 334 and a pair of the rectangular retaining slots 335 formed on the vertical portion 337 of the lateral sides 336 respectively.

The pendulum 40 has a rectangular body 41, a tubular suspender 42 perpendicularly extended across the flat partion and located in the proximity of the lower end of the body 41, a rectangular cup 43 formed perpendicular to the upper end thereof for retaining a retaugular magnnet 44 therein and a hook means 45 extended downward from the lower end thereof for attaching a bob (not shown) thereon.

The rectangular cover 50 has a knife-edge pivot axis 51 projected from the center of the inward surface and a pair of the spring tabs 52 protruded inwardly from the lateral sides respectively having a reverse hook 521 formed on their free ends.

When the pendulum 40 attaches on its tubular suspender 42 to the knife-edge pivot axis 333 inside the third chamber 33 of the housing 30, the rectangular cover 50 will insert on its knife-edge pivot axis 51 into the outward end of the tubular suspender 42 and align with the corresponding pivot axis 333 and the pair of the spring tabs 52 snap into the pair of the respective retaining slots 335 on the lateral side 336 of the third chamber 33. So that the magnet 44 locates directly under the electric coil inside the second chamber 32 to actuate the pendulum 40 with bob 46 swinging laterally and reciprocally on the pivot axises 51 and 333 upon the variation of the electromagnetic field between the coil and the magnet 44. (as shown in FIG. 3). To press the tabs 52 out of the slots 335 with a pin will provide a ready disassembly of the pendulum 40 from the chamber 33.

Based on aforediscussed embodiment, the structure of an ultrathin electromagnetic clock of the present invention provides a housing greatly thiner than that of the prior art, which will meet the user's desire for a cosmetic effect and the producer's requirement for ready to manufacture. Note that the spcification relating to the above embodiment should be construed as to exemplary rather than as limitative of the present invention, with many variations and modifications being readily attainable by a person of average skill in the art without apparting from the spirit or scope thereof as defined by the appended claims and their legal equivalents.

I claim:

1. A structure of an ultrathin clock comprising generally a roughly rectangular housing, a pendulum and a flat rectangular cover therefor, wherein:

said housing comprising a first chamber on an upper portion for disposing a clockwork mechanism and dial therein, a second chamber on the median portion for disposing a set of an electric circuit and batteries and a third chamber on the lower portion for pivoting said pendulum therein;

said third chamber comprising a roughly inverted trapezoid body having an opening on the back side, a window on the front side, a knife-edge pivot axis projected at a center on the inward surface of a front wall thereof and a pair of retaining slots respectively formed on the lateral sides thereof;

said pendulum comprising a flat rectangular body having a tubular suspender perpendicularly extended across the flat body and in the proximity of the lower end of said body, a rectangular cup formed perpendicular to the upper end thereof for retaining a magnet therein and a hook means extended downward from the lower end thereof for attaching a bob thereon;

said cover comprising a corresponding knife-edge pivot axis projected from a center of the inward surface thereof and a pair of the spring tabs having reverse hooks projected inwardly from the lateral sides thereof;

whereby, said pendulum is attached on said tubular suspender to said pivot axis inside said third chamber and supported by said correspponding pivot axis of said cover which is snapped on said pair of spring tabs thereof into said pair of retaining slots of said third chamber.

2. A structure of an ultrathin clock according to claim 1, wherein said magnet of said pendulum is disposed directly under an electric coil inside said second chamber.

3. A structure of an ultrathin clock according to claim 2, wherein said pendulum swings laterally and reciprocally on said pivot axis upon the variations of the electromagnetic field between said electric coil and said magnet.

* * * * *